United States Patent [19]

Beer et al.

[11] Patent Number: 5,060,803

[45] Date of Patent: Oct. 29, 1991

[54] GUSSETTED FLEXIBLE PACKAGE WITH TEAR NOTCH TO FORM POUR SPOUT

[76] Inventors: Jeffrey S. Beer, 2340 Hill Rd., Perkiomenville, Pa. 18074; Daniel R. Wigman, 512 Woodbridge Cir., Harleysville, Pa. 19438

[21] Appl. No.: 642,601

[22] Filed: Jan. 17, 1991

[51] Int. Cl.[5] ..... B65D 33/00

[52] U.S. Cl. ..... 206/610; 206/632

[58] Field of Search ..... 206/604, 610, 629, 632; 383/91

[56] References Cited

U.S. PATENT DOCUMENTS

| | | | |
|---|---|---|---|
| 2,248,266 | 7/1941 | Abrams | 206/604 |
| 2,349,369 | 5/1944 | Norseen | 383/91 |
| 2,923,404 | 2/1960 | Adell | 206/610 |
| 3,051,368 | 8/1962 | Schneider et al. | 206/632 |
| 3,397,835 | 8/1968 | Henning | 206/610 |
| 3,516,537 | 6/1970 | Dreyfus et al. | 206/632 |
| 3,542,190 | 11/1970 | Keller | 206/632 |
| 3,873,735 | 3/1975 | Chalin et al. | 206/604 |
| 4,428,485 | 1/1984 | Egli | 206/604 |
| 4,795,270 | 1/1989 | Heyden | 206/632 |
| 4,986,673 | 1/1991 | Bell | 206/610 |

*Primary Examiner*—Gary E. Elkins

*Attorney, Agent, or Firm*—Caesar, Rivise, Bernstein, Cohen & Pokotilow, Ltd.

[57] ABSTRACT

A package having a hollow interior for holding material therein. The package is formed of flexible sheet material and comprises a pair of panels connected by respective side gusset folds, a mouth located between the side gusset folds and communicating with the interior of the package, and a pair of notches and associated seals. Each of the folds comprises a central fold edge interposed between a pair of outer fold edges and defining therebetween respective gusset sections which are subadjacent the respective panels. The mouth of the package is sealed to hold the material within the interior of the package isolated from the ambient atmosphere. Each notch is formed in a respective one of the outer fold edges and the panel and gusset section contiguous therewith. The seal is air-tight and surrounds the associated notch to join the panel and contiguous gusset section to each other to preclude air from entering into the interior of the package through the notch. The notches enable the package to be torn open therefrom to form a pouring spout through which free flowing grannular products can be poured at a controlled rate.

14 Claims, 4 Drawing Sheets

FIG. 5
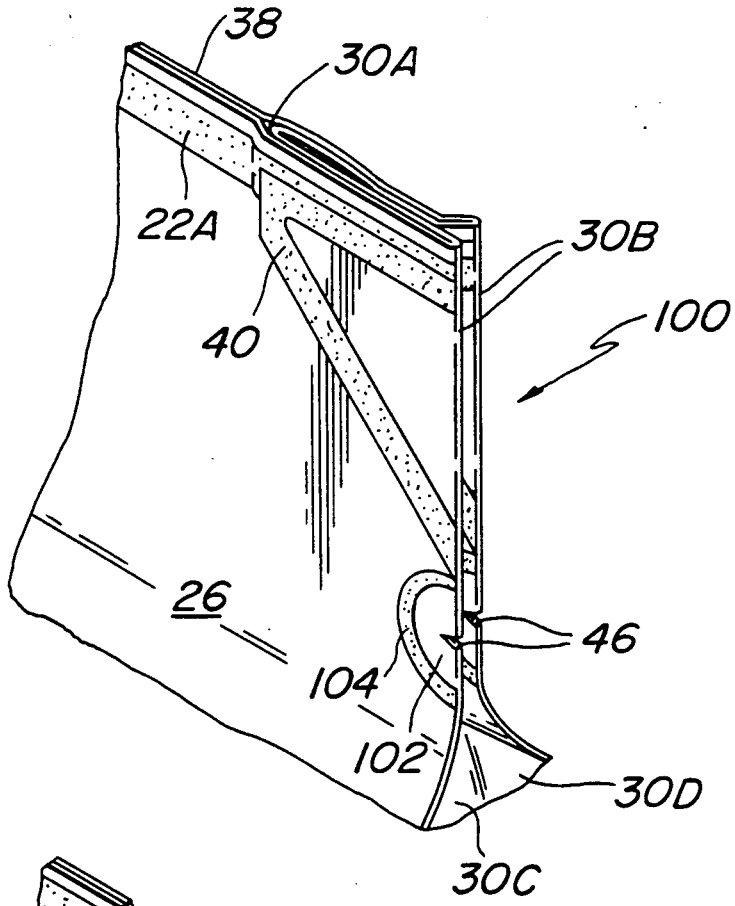
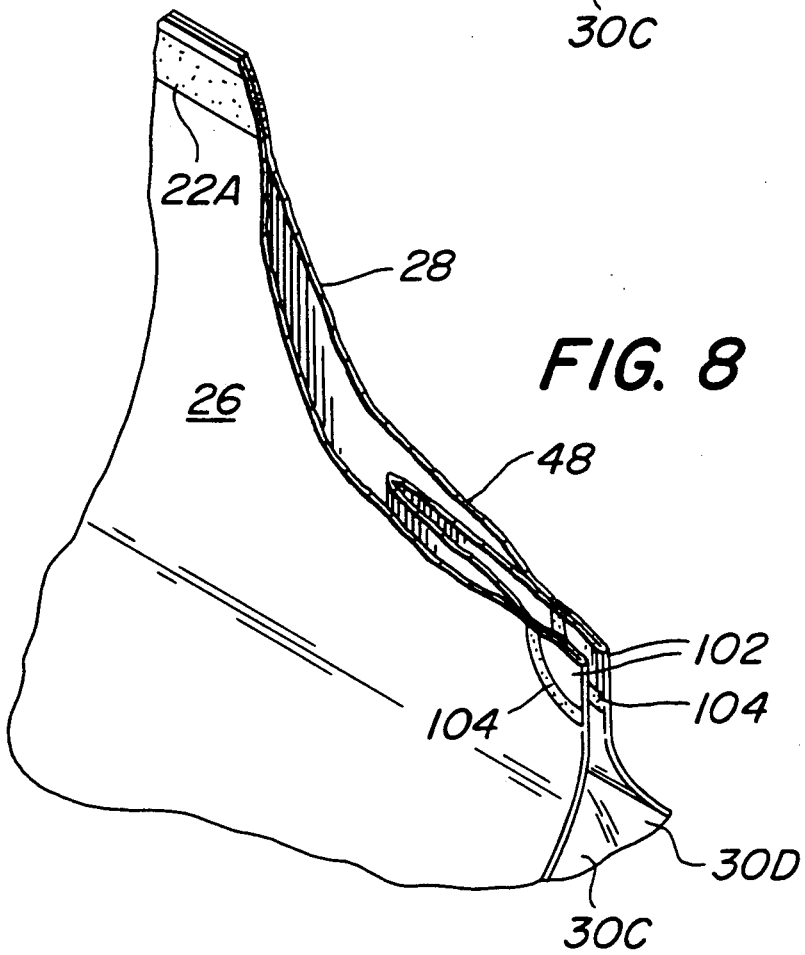
FIG. 8

GUSSETTED FLEXIBLE PACKAGE WITH TEAR NOTCH TO FORM POUR SPOUT

BACKGROUND OF THE INVENTION

This invention relates generally to packaging and more particularly to flexible packaging.

Flexible containers formed of sheet materials have gained wide acceptance in the trade for holding foodstuffs, powdered chemicals, or other air-perishable materials therein. One common type of flexible package container is the so-called "gussetted package". Such packages are typically made of a web of flexible stock material, e.g., polyethylene, polyester, polypropylene, metal foil, or combinations thereof in single or multiple plies. The web is formed into a tubular body having a front panel, a rear panel, and a pair of gussetted side panels. Each gussetted side panel comprises a pair of gusset sections having a central fold edge interposed between a pair of outer fold edges. The marginal edges of the front and rear panels of the package form the outer fold edges. The outer fold edges of one side of both panels and the interposed central fold edge define respective gusset sections therebetween. Those sections are subadjacent (i.e., underlie) the marginal edges of their associated panels.

The lower end of many such prior art gussetted packages are commonly permanently, e.g., heat, sealed along a line extending transversely across the width of the package close to the bottom edge of the package. The upper end of each package is commonly left open to form a mouth for filling, and in many cases, emptying, the package. In particular, it is common to form the mouth of the package with some sealable, e.g., heat sealable, means. This enables the package to be sealed at its mouth after the package is filled with the desired contents.

In U.S. Pat. No. 4,913,561 entitled Gussetted Flexible Package With Presealed Portions and Method of Making the Same, which is assigned to the same assignee as this invention, and whose disclosure is incorporated by reference herein there are disclosed flexible containers having a mouth extending between the gussets which can be readily sealed by the application of heat and pressure thereto to form a readily peelable mouth through which the contents of the package may be poured.

While such packaging is suitable for its intended purposes, the readily peelable seal may not be strong enough for some applications, e.g., holding powdered chemicals which may be subject to harsh or rough handling. Moreover, the use of a readily peelable mouth in a package adds to the cost thereof. Thus, for some applications it may not be desirable to utilize peelable means at the mouth of the package to enable it to be peeled open to pour the contents of the package therethrough.

Tear notches have been used to serve as means for providing easy opening of non-gussetted packages. Many examples of such packages are in use today. One such package comprises a pair of gussets on opposite sides of a bottom seal and a gusset on only one side of the top seal. The other side of the top seal is not gussetted to form a pour spout. In order to open the pour spout the non-gussetted portion at the side of the top seal is provided with a tear notch. Accordingly, the pour spout can be opened by tearing the package from its tear notch.

The use of tear notches in non-gussetted packages or in non-gussetted portions of packages to form an open pour spout has proved to be a less than optimum packaging approach. This results from the inability of such packages to maintain their shape.

Thus, the need presently exists for a gussetted flexible package having strong non-peelable seals but which includes means for producing a pouring spout, with little or no additional cost.

OBJECTS OF THE INVENTION

Accordingly, it is a general object of this invention to provide flexible containers which overcome the disadvantages of the prior art.

It is still a further object of this invention to provide a package formed of a strong, flexible material which includes means for enabling the ready tearing of the package to form a pouring spout.

It is a further object of this invention to provide a package for storing material under vacuum therein and which includes means for enabling the package to be torn to form a pouring spout, yet without compromising the property of the package to isolate the contents of the package from the ambient atmosphere until the pouring spout is formed.

It is yet a further object of this invention to provide a flexible package for storing material under vacuum therein which includes relatively simple and inexpensive means for enabling the package to be torn to form a pouring spout.

It is still a further object of this invention to provide a flexible package for storing material under vacuum therein which includes means for enabling the package to be torn to form a pouring spout through which free flowing grannular products can be poured at a controlled rate.

SUMMARY OF THE INVENTION

These and other objects of the instant invention are achieved by providing a flexible package having a hollow interior for holding material therein. The package is formed of flexible sheet material and comprises a pair of panels connected by a pair of side folds, a mouth located between the side folds and communicating with the interior of the package, and means for forming a pouring spout for the package. Each of the package's side folds comprises a fold edge. The mouth of the package is sealed to hold the material within the interior of the package isolated from the ambient atmosphere. The means for forming the pouring spout comprises at least one notch formed in at least one of the fold edges and the portions of the package contiguous therewith, and an air-tight seal surrounding the notch and joining the contiguous portions of the package to each other to preclude air from entering into the interior of the package through the notch.

In accordance with one preferred aspect of this invention the package is gussetted.

DESCRIPTION OF THE DRAWING

FIG. 5 is a perspective view of a portion of a filled and sealed package constructed in accordance with another embodiment of this invention;

FIG. 8 is a perspective view of the portion of the filled and sealed package shown in FIG. 5 after a pour spout has been formed therein.

DETAILED DESCRIPTION OF THE PREFERRED EMBODIMENTS

Figure 1:
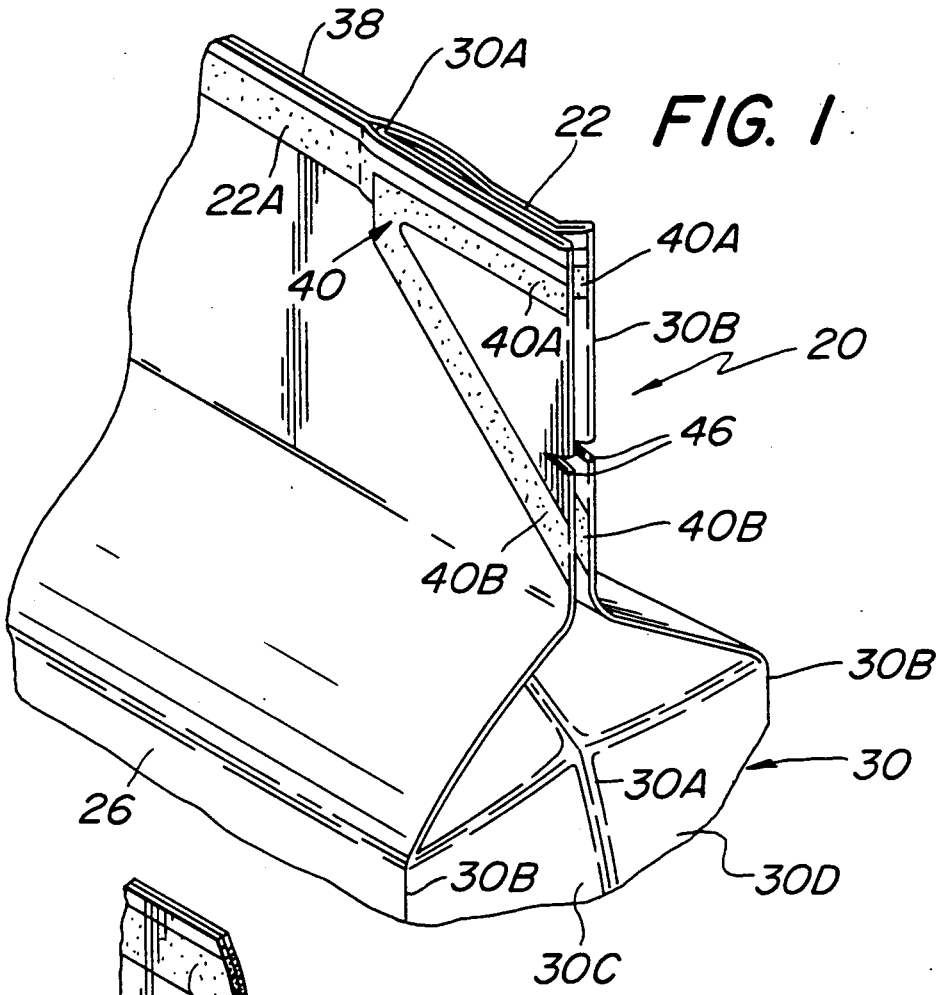
FIG. 1 is a perspective view of a portion of a filled and sealed package constructed in accordance with one embodiment of this invention.
Figure 2:
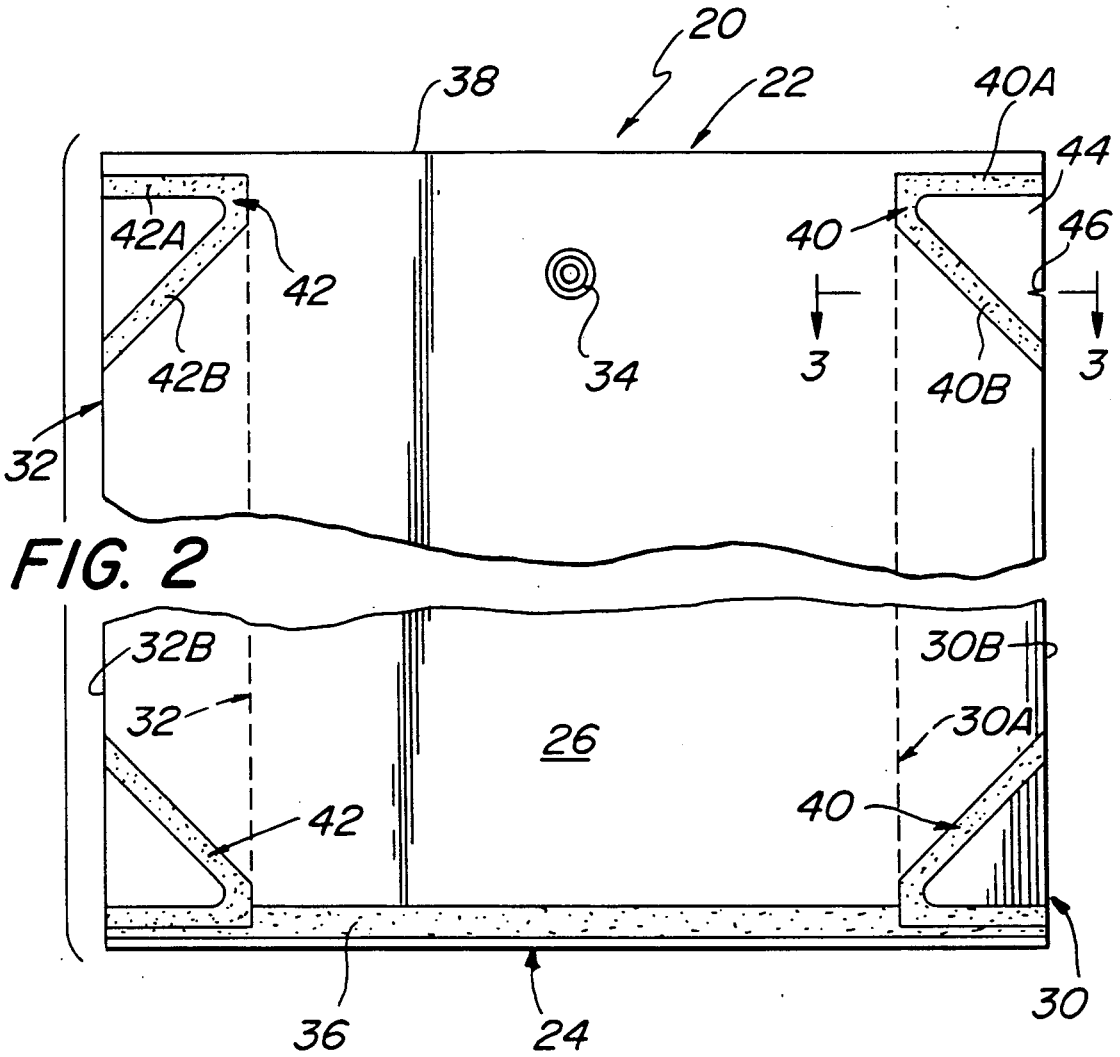
FIG. 2 is a reduced plan view of the package shown in FIG. 1 prior to filling and sealing.

Referring now to various figures of the drawing wherein like reference numerals refer to like parts, there is shown at 20 in FIGS. 1 and 2, one embodiment of the package of the subject invention. The package 20 is fabricated from a long strip of any suitable flexible sheet material which is formed into a tube. The details of the construction of the package will be described later. Suffice it for now to state that the package 20 as shown herein is of the gussetted type and has an upper end 22 including a mouth which is arranged to be sealed after the bag is filled, and a sealed lower end 24 (FIG. 2). The package is arranged to be filled with some product, e.g., a powdered chemical composition, through the mouth. The mouth is then sealed, e.g., heat sealed, to enclose the contents of the package therein and to isolate it from the ambient atmosphere. In some cases the package 20 is sealed under vacuum.

It must be pointed out at this time that while the package 20 shown in FIG. 1 herein is of the gussetted type, the subject invention is not limited to packages having gussetted sides. It should also be pointed out that the package 20 shown herein is preferably manufactured (fabricated) as one of a large number of serially connected, identical packages, in a manner like that described in the aforementioned patent application.

Figure 3:
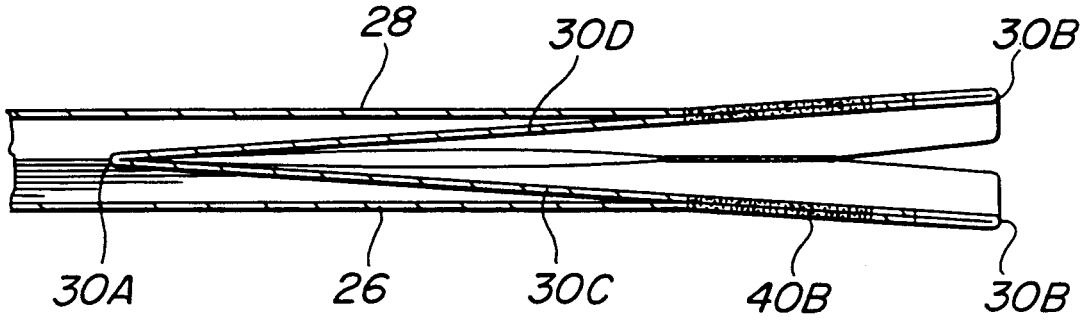
FIG. 3 is an enlarged sectional view taken along line 3—3 of FIG. 2.
Figure 6:
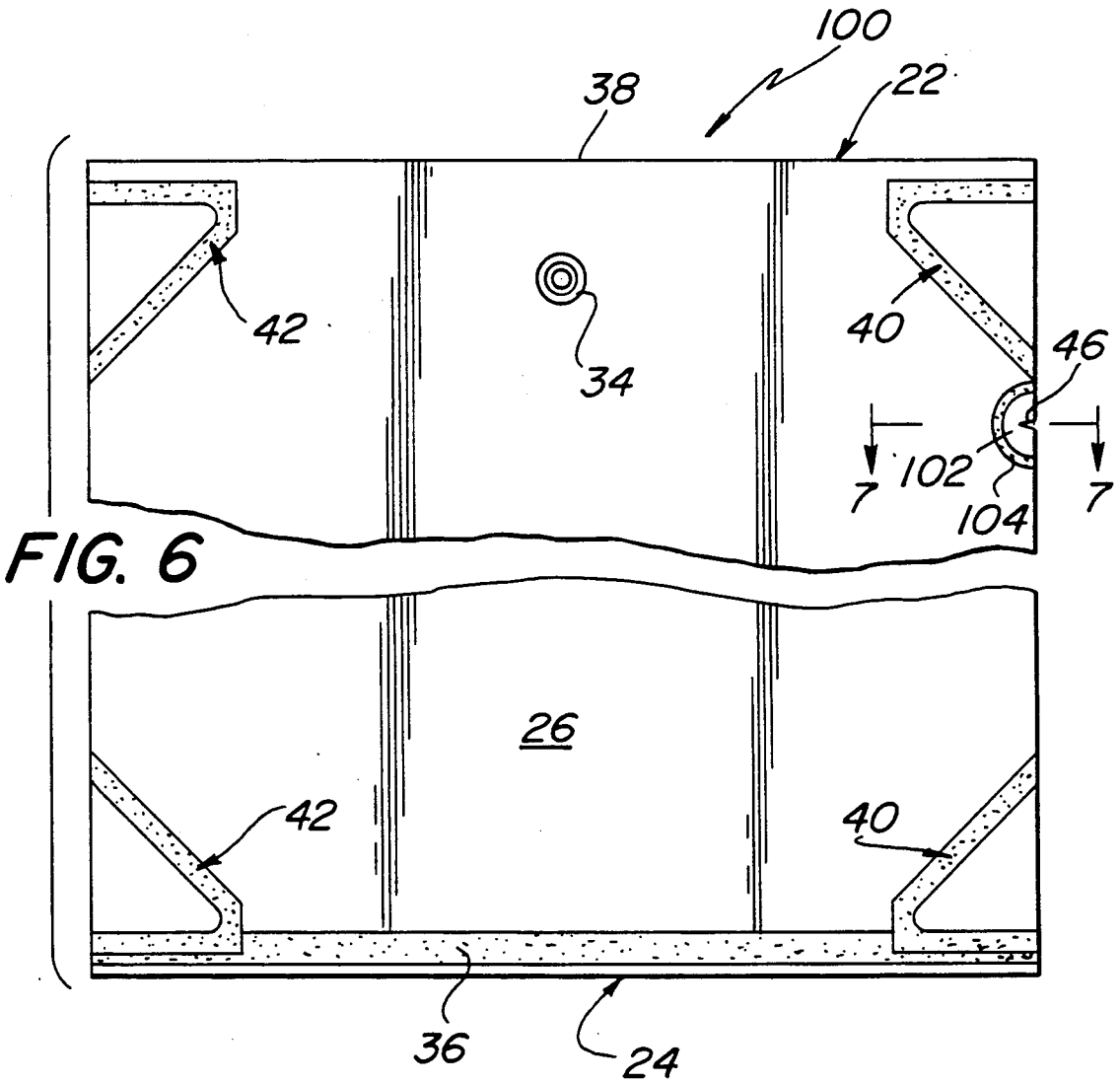
FIG. 6 is a reduced plan view of the package shown in FIG. 5 prior to filling and sealing.
Figure 7:
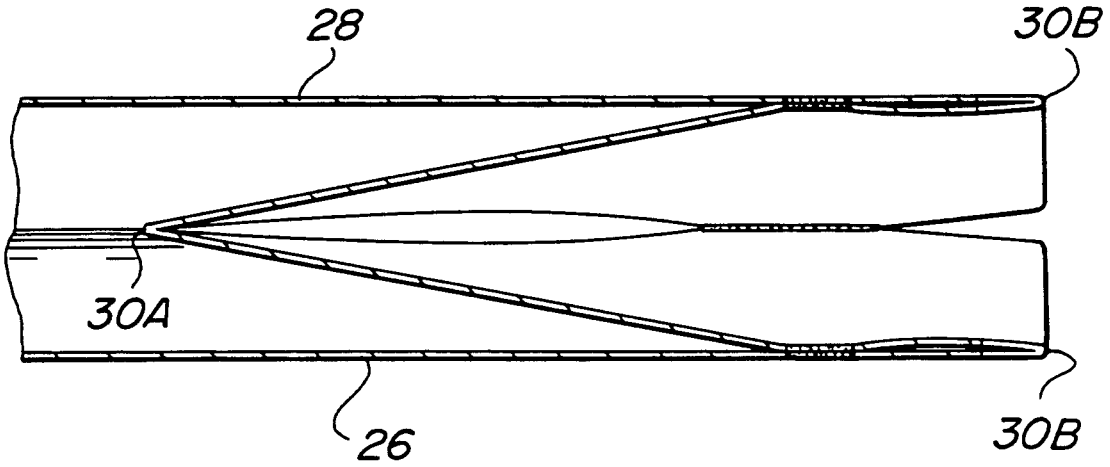
FIG. 7 is an enlarged sectional view taken along line 7—7 of FIG. 6.

Referring now to FIGS. 1, 2 and 3, the details of the construction of the package 20 will now be described. As can be seen the package basically comprises a front wall or panel 26, a rear wall or panel 28, a first side gusset 30, a second side gusset 32, the heretofore identified top end 22, the heretofore identified bottom end 24, and a one-way venting valve 34. The valve 34 is mounted in the front panel to enable gases contained within the package 20 to vent to the ambient air, without any air gaining ingress to the package's interior.

The front panel 26, rear panel 28, and the two side gussets 30 and 32 of the package 20 are all integral portions of the single sheet or web of flexible material which has been folded and seamed to form a tubular body. Thus, the back panel of the package includes a longitudinally extending vertical seam (not shown) formed by the marginal edges of the sheet or web section which are brought into engagement with each other. Those edges are permanently secured to one another via any conventional sealing technique, such as heat sealing or welding. The lower end of the package is also sealed closed along a permanent seam line 36. That seam line is also formed using conventional sealing techniques such as those used for the vertical seam at the back of the package.

The side gussets 30 and 32 are of identical construction. Thus, the same reference characters will be used on the corresponding components forming the gussets 30 and 32. To that end, as can be seen clearly in FIGS. 1-3, the gusset 30 comprises a central fold edge 30A interposed between a pair of outer fold edges 30B. The central fold edge and the outer fold edges all are parallel to the longitudinal axis of the package, i.e., the vertical seam in the rear of the package. In a similar manner, the gusset fold 32 comprises central fold edge 32A interposed between a pair of outer fold edges 32B.

Two of the outer fold edges 30B and 32B form the marginal edges of the front panel 26, while the other two of the outer fold edges 30B and 32B form the marginal edges of the rear panel 28. The pair of outer fold edges 30B define therebetween first and second gusset sections 30C and 30D, respectively. As can be seen in FIG. 3, the first and second gusset sections 30C and 30D are subadjacent, that is, lie under, the marginal edge portions of the front and rear panels 26 and 28, respectively. Similarly, the first and second gusset sections 32C and 32D are subadjacent the marginal edge portions of the front and rear panels 26 and 28, respectively.

The upper end of the package includes a mouth portion which is initially unsealed, that is open. That portion is denoted by the reference numeral 38 and is defined between a pair of conventional side seals 40 and 42 (FIG. 2).

The two side seals 40 and 42 are of identical construction. Thus, the same reference characters will be used on the corresponding components forming the side seals 40 and 42. To that end, as can be seen the side seals 40 and 42 each comprise respective transversely oriented seals 40A and 42A and respective angularly diverging seals 40B and 42B. The transversely extending seal 40A seals or secures the front panel 26 to its subadjacent gusset section 30C while the associated angularly diverging seal 40B also seals the front panel 26 to the subadjacent gusset section 30C. In the identical manner the other transversely extending seal 40A of the seals 40 seals the rear panel 28 to its subadjacent section 30D and at the same time the angularly extending seal 40B seals the rear panel 28 to that subadjacent gusset section 30D.

As can be seen the transverse and angularly extending seals extend the full width of the gusset sections, that is seal the gusset sections from the outer fold edge to the center or inner fold edge. Moreover, since the angularly extending seal line merges with the transverse seal line at the center or inner fold edge a respective portion 44 of each gusset on each side of the package is defined between the lateral and angularly extending seals. It is in this area 44 that the means, e.g., a pair of notches 46 to be described later, for forming the pour spout are located.

With the side seals being formed as just described virtually all of the medial portion of the inner surfaces of those panels between the side seals are unsecured, that is, open. This creates the heretofore identified open mouth 38. It is through this mouth that the package may be filled. The package is then be sealed across the entire width of the package at the top thereof to permanently seal the contents within the package. Such action may be accomplished under vacuum to hermetically seal the contents within the package. The top heat seal line is designated by the reference numeral 22A.

Figure 4:
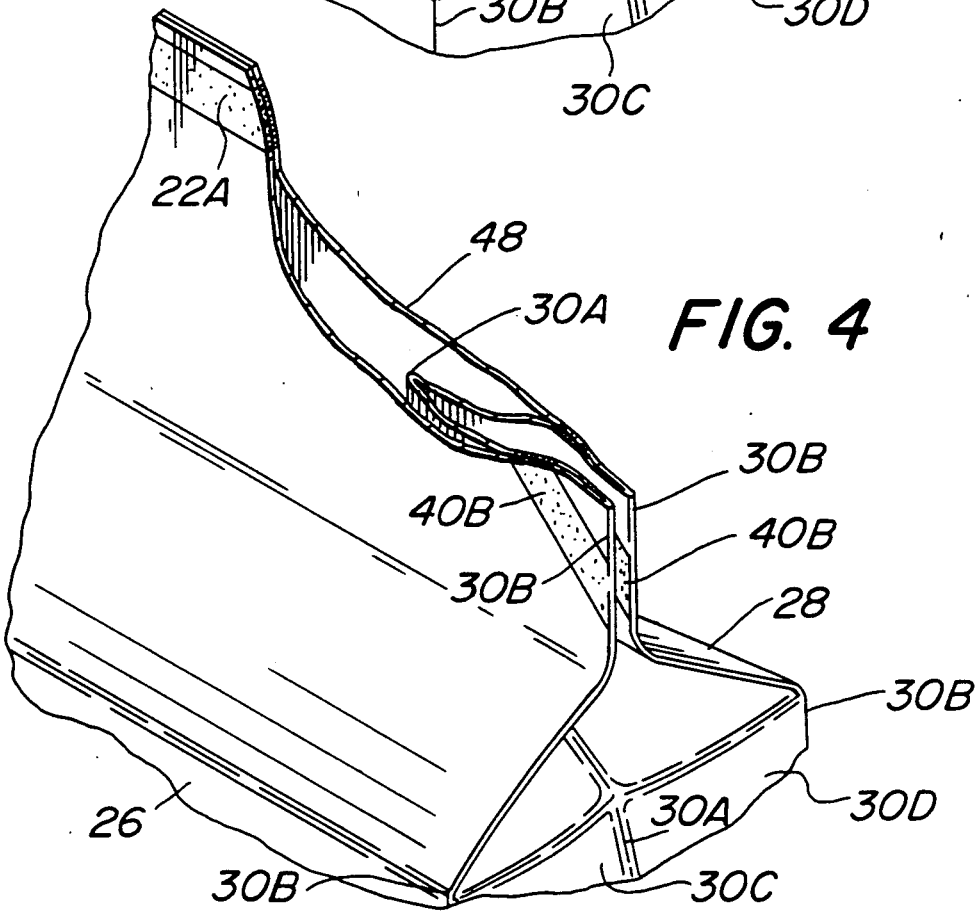
FIG. 4 is a perspective view of the portion of the filled and sealed package shown in FIG. 1 after a pour spout has been formed therein.

The material forming the package is generally quite tough and resistant to tearing. Thus, the package 20 includes the aforementioned notches 46 to enable the package to be torn at the top thereof to create a pour spout 48 (FIG. 4). Each of the notches 46 is located within a respective area 44 which surrounded by the transverse and angularly extending heat seals 40A and 40B, respectively, of the side seals 40. Thus, the surrounding heat seals isolate the notches from the interior of the package, so that the notches do not provide any means for air to gain ingress into the interior of the package. As can be seen clearly in FIG. 1 each notch 46 is of generally V-shape. This forms a weakened point in the material to facilitate the tearing of the material of the package starting therefrom. Thus, in order to form the pour spout 48 all that is required is for the user to grasp the marginal edges of the package adjacent fold lines 30B at the location of the notches 46 and to pull on the upper portion of the package above the notches in a generally diagonally oriented direction toward the center of the upper end of the package. This action tears away a corner of the package and thus create a pour spout 48 like that shown in FIG. 4. The package can then be tilted to pour its contents out the pour spout in a controlled manner.

In FIGS. 5–8 an alternative embodiment of a package constructed in accordance with this invention is shown. That package is designated by the reference numeral 100 and for all intents and purposes it is the same as the package 20 as described heretofore, except that the notches 46 are located below side seal 40 and within areas 102 bounded by respective arcuate heat seals 104. Thus, one arcuate heat seal 104 is provided to seal the front panel 26 and the subadjacent gusset section 30C, with the ends of the arcuate heat seal terminating at the outer fold line 30B. Similarly, the other arcuate heat seal 104 is provided to seal the rear panel 28 and its subadjacent gusset section 30D, with the ends of that seal terminating at the outer fold line 30B.

In view of the commonality of construction between the packages of FIGS. 1 and 5, those structural features which are identical in each package are given the same reference numerals and their description and discussion of the operation thereof will not be reiterated. Suffice to state that the pour spout 48 of the package 100 is formed in a similar manner to the pour spout 48 of the package 20 by tearing the package from its notches 46.

Without further elaboration the foregoing will so fully illustrate our invention that others may, by applying current or future knowledge, adopt the same for use under various conditions of service.

We claim:

1. A gussetted flexible package having a hollow interior for holding material therein, said package being formed of flexible sheet material and comprising a pair of panels each having a pair of sides connected by respective gusset folds, a mouth located between said gusset folds and communicating with said interior, and means for forming a pouring spout for said package, each of said gusset folds comprising a central fold edge interposed between a pair of outer fold edges and defining therebetween two respective gusset sections, wherein one of said gusset sections of one gusset fold is contiguous with one of said outer fold edges and contiguous and subadjacent one of said panels on one side thereof, and the other of said gusset sections of said one gusset fold is located contiguous with the other of said outer fold edges and contiguous and subadjacent the other of said panels on said one side, said mouth of said package being sealed to hold said material within said interior of said package isolated from the ambient atmosphere, said means for forming said pouring spout comprising at least one notch formed in at least one of said outer fold edges of said one gusset fold and the one panel and gusset section contiguous therewith and a first air-tight seal surrounding said notch and joining said one panel and contiguous gusset section to each other to preclude air from entering into said interior of said package through said notch.

2. The package of claim 1 wherein said material of said package is tearable, said notch enabling the material of the package to be torn open therefrom into said mouth to form said pouring spout.

3. The package of claim 1 wherein the other of said outer fold edges of said one gusset fold also comprises a notch formed in said other outer fold edge and the other panel and gusset section contiguous therewith and a second air-tight seal surrounding said notch and joining said other panel and contiguous gusset section to each other.

4. The package of claim 1 wherein said seal is a heat seal.

5. The package of claim 2 wherein said seal is a heat seal.

6. The package of claim 4 wherein said heat seal is arcuate in shape.

7. The package of claim 6 wherein said heat seal is semicircular.

8. The package of claim 5 wherein said heat seal is arcuate in shape.

9. The package of claim 8 wherein said heat seal is semicircular.

10. The package of claim 3 wherein each of said seals is a heat seal.

11. The package of claim 10 wherein each of said heat seals is arcuate in shape.

12. The package of claim 10 wherein each of said heat seals comprises a transversely extending seal line and an angularly diverging seal line defining a space therebetween in which said notch is located.

13. The package of claim 4 wherein each of said heat seals comprises a transversely extending seal line and an angularly diverging seal line defining a space therebetween in which said notch is located.

14. The package of claim 5 wherein each of said heat seals comprises a transversely extending seal line and an angularly diverging seal line defining a space therebetween in which said notch is located.

* * * * *